US010018347B2

(12) United States Patent
Zhou et al.

(10) Patent No.: US 10,018,347 B2
(45) Date of Patent: Jul. 10, 2018

(54) BULB LAMP STRUCTURE HAVING A BULB HOUSING, HEAT DISSIPATER AND INLET AND OUTLET VENTILATION HOLES FORMED IN SEAT AND UPPER PORTION OF BULB HOUSING

(71) Applicant: MAINHOUSE (XIAMEN) ELECTRONICS CO., LTD., Xiamen (CN)

(72) Inventors: Nanqing Zhou, Xiamen (CN); Rongkui Wu, Xiamen (CN)

(73) Assignee: MAINHOUSE (XIAMEN) ELECTRONICS CO., LTD., Xiamen, Fujian (CN)

( * ) Notice: Subject to any disclaimer, the term of this patent is extended or adjusted under 35 U.S.C. 154(b) by 109 days.

(21) Appl. No.: 15/108,781

(22) PCT Filed: Oct. 30, 2014

(86) PCT No.: PCT/CN2014/089864
§ 371 (c)(1),
(2) Date: Jun. 28, 2016

(87) PCT Pub. No.: WO2016/065566
PCT Pub. Date: May 6, 2016

(65) Prior Publication Data
US 2016/0320047 A1 Nov. 3, 2016

(51) Int. Cl.
*F21V 29/83* (2015.01)
*F21V 29/00* (2015.01)
(Continued)

(52) U.S. Cl.
CPC ..... *F21V 29/83* (2015.01); *F21K 9/232* (2016.08); *F21K 9/235* (2016.08); *F21K 9/238* (2016.08);
(Continued)

(58) Field of Classification Search
CPC ..... F21Y 2115/10; F21V 29/83
See application file for complete search history.

(56) References Cited

U.S. PATENT DOCUMENTS 7,513,653 B1 * 4/2009 Liu ..... F21V 29/004 362/218
8,143,769 B2 * 3/2012 Li ..... F21V 29/004 313/46

(Continued)

*Primary Examiner* — Robert May
(74) *Attorney, Agent, or Firm* — Leong C. Lei

(57) ABSTRACT

A bulb lamp structure includes a base, a seat, a circuit board, and a bulb housing, and further includes a plurality of chips on which LEDs are mounted, a heat dissipater, and a double-sided board. The seat has a lower rim in which an air inlet opening is formed. The heat dissipater has a lower portion forming an annular hood that has an upper end on which a plurality of plate-like substrates is arranged to circumferentially delimit a chamber in communication with the air inlet opening of the seat. The chips are respectively mounted on outside surfaces of the substrates. The bulb housing has a top end having a central portion in which a ventilation hole is formed to correspond to an air outlet opening formed in a top of the heat dissipater. A large illumination angle can be effectively realized and automatic production can be facilitated.

9 Claims, 6 Drawing Sheets

(51) Int. Cl.

| | |
|---|---|
| ***F21S 2/00*** | (2016.01) |
| ***F21V 19/00*** | (2006.01) |
| ***F21V 29/74*** | (2015.01) |
| ***F21K 9/238*** | (2016.01) |
| ***F21K 9/232*** | (2016.01) |
| ***F21K 9/235*** | (2016.01) |
| ***F21V 23/00*** | (2015.01) |
| *F21Y 115/10* | (2016.01) |

(52) U.S. Cl.
CPC ..... *F21S 2/00* (2013.01); *F21V 19/00* (2013.01); *F21V 23/006* (2013.01); *F21V 29/00* (2013.01); *F21V 29/74* (2015.01); *F21Y 2115/10* (2016.08)

(56) References Cited

U.S. PATENT DOCUMENTS

| | | | | |
|---|---|---|---|---|
| 8,487,518 | B2 * | 7/2013 | Johnston | G02B 6/0085 313/46 |
| 8,926,131 | B2 * | 1/2015 | Johnston | F21V 17/005 362/249.02 |
| 8,952,613 | B2 * | 2/2015 | Anderson | F21V 3/02 315/112 |
| 2011/0115358 | A1 * | 5/2011 | Kim | F21V 29/20 313/46 |

* cited by examiner

BULB LAMP STRUCTURE HAVING A BULB HOUSING, HEAT DISSIPATER AND INLET AND OUTLET VENTILATION HOLES FORMED IN SEAT AND UPPER PORTION OF BULB HOUSING

TECHNICAL FIELD OF THE INVENTION

The present invention relates generally to a lighting fixture, and more particularly to a bulb lamp structure that involves a light-emitting diode (LED) as a light source and mimics a conventional incandescent lamp.

DESCRIPTION OF THE PRIOR ART

A light-emitting diode (LED) is made of an electroluminescent material and has various advantages, such as low voltage, high performance, high monochromaticity, high adaptability, good stability, short response time, long lifespan, and being free of contamination to the environment, and has thus been widely used in fields of for example lighting and decoration. An LED light bulb that is based on an LED chip is available in the market and an importance difference between such an LED light bulb and a traditional incandescent lamp bulb is that a light emission source of the bulb is replaced by an LED chip.

As shown in FIGS. 1 and 2, a conventional LED bulb lamp that is commonly available in the market is shown, having a structure that comprises a base 1', a seat 2' that is coupled to the base 1' to serve as a heat dissipater, a circuit board arranged in the seat 2', and a chip 3' arranged on a top end of the seat 2'. The chip 3' comprises LEDs 31' mounted thereon. A bulb housing 4' encloses and houses the chip 3' and is coupled to an upper rim of the seat 2'. The seat 2' can be of a shining surface and is provided on an outer surface thereof with heat dissipation fins 21' to increase a heat dissipation area thereof. The circuit board is connected to the chip 3' and the base 1' through wires 5'. Since heat dissipation of the LED chip is a factor that determines lighting efficiency and lifespan, to ensure good heat dissipation, the conventional LED bulb lamp is structured such that the seat 2' has an enlarged size to maintain the heat dissipation efficiency of the LEDs. Thus, the conventional LED bulb lamp shows a significant difference in the outside configuration from that of a traditional incandescent bulb. Further, the chip 3' of the LED bulb lamp is positioned flat on the top of the seat 2' so that the illumination direction is generally on the top of the bulb lamp and thus there is an issue of relatively small illumination range. Further, the circuit board and the chip 3' are connected through the wires 5' and this is adverse to automatic production. Thus, the conventional LED bulb lamp generally has a limited throughput and the manufacture cost is high.

The present invention is made in view of the above-discussed problems of the conventional LED bulb lamp.

SUMMARY OF THE INVENTION

An object of the present invention is to provide a bulb lamp structure that involves an LED as a light source and has an outside configuration that is closer to an incandescent bulb and also provides a large illumination angle, excellent heat dissipation property, and an effect of facilitating automatic manufacture.

To achieve the above object, a technical solution adopted in this invention is as follows:

A bulb lamp structure comprises a base, a seat that is coupled to the base, a circuit board that drives LED chips, and a bulb housing that encloses and houses the chips and is coupled to the seat and comprises a plurality of chips on which LEDs are mounted, a heat dissipater, and a double-sided board that connects the chips to the circuit board. The seat has a lower portion in which an air inlet opening is formed and the heat dissipater has a lower portion that forms an annular hood received and mounted in the seat. The annular hood has an upper end to which a plurality of plate-like substrates is mounted to extend upward in a manner of being spaced from each other. The plate-like substrates is circumferentially arranged to surround and delimit a chamber. The chamber is in a form of gradually reducing from bottom to top so that a top end of the chamber is convergent to form an air outlet opening. The chamber has a bottom that is in communication with the air inlet opening of the seat. The circuit board is arranged, in a longitudinal direction, in the seat. The chips re respectively mounted to outside surfaces of the plate-like substrate. The bulb housing has a top end having a central portion in which a ventilation hole is formed to correspond to the air outlet opening located in an upper end of the heat dissipater.

The seat has a lower rim that is adjacent to the base and comprises the air inlet opening arranged therein.

The circuit board has an upper end positioned in abutting engagement with the heat dissipater and a lower end connected to the base. The double-sided board is fit over and encompasses the heat dissipater and is connected to the chips and the circuit board.

A cover plate is further provided above the double-sided board. The cover plate is in the form of an annular cover that is fit over and encompasses the plate-like substrate to be located above the double-sided board.

Each of the plate-like substrates of the heat dissipater has an upper end that is constrained in position by a cap. The cap comprises an air passage opening formed therein and in communication with the chamber. The air passage opening is arranged to extend to a site corresponding to the ventilation hole of the bulb housing.

With the above technical solution, the present invention provides a heat dissipater that comprises a plurality of longitudinally arranged plate-like substrates to which chips are mounted such that spacing gaps among the plate-like substrates serve as airflow passages. The plate-like substrates circumferentially surround and delimit a chamber having a bottom in communication with an air inlet opening of a seat and a top in communication with a ventilation hole formed in a bulb housing to thereby define an airflow channel. When LEDs are put into operation, high temperature inside the bulb housing can move through the airflow passages to move out of the bulb housing through the airflow channel. Compared with the conventional LED bulb lamp where heat dissipation is conducted through physical contact with heat dissipation fins of a seat, the present invention provides a more efficient way of heat dissipation and thus exhibits better heat dissipation performance, making it advantageous to the lifespan of the LEDs. Further, the chips are arranged, in a three-dimensional form, in the bulb housing so as to allow the outside configuration of the bulb lamp closer to that of a traditional incandescent bulb and also provide an enlarged angle of illumination of the LEDs to cover a widened range of illumination. Further, the chips are connected to the circuit board via the double-sided board so as to facilitate automatic production.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
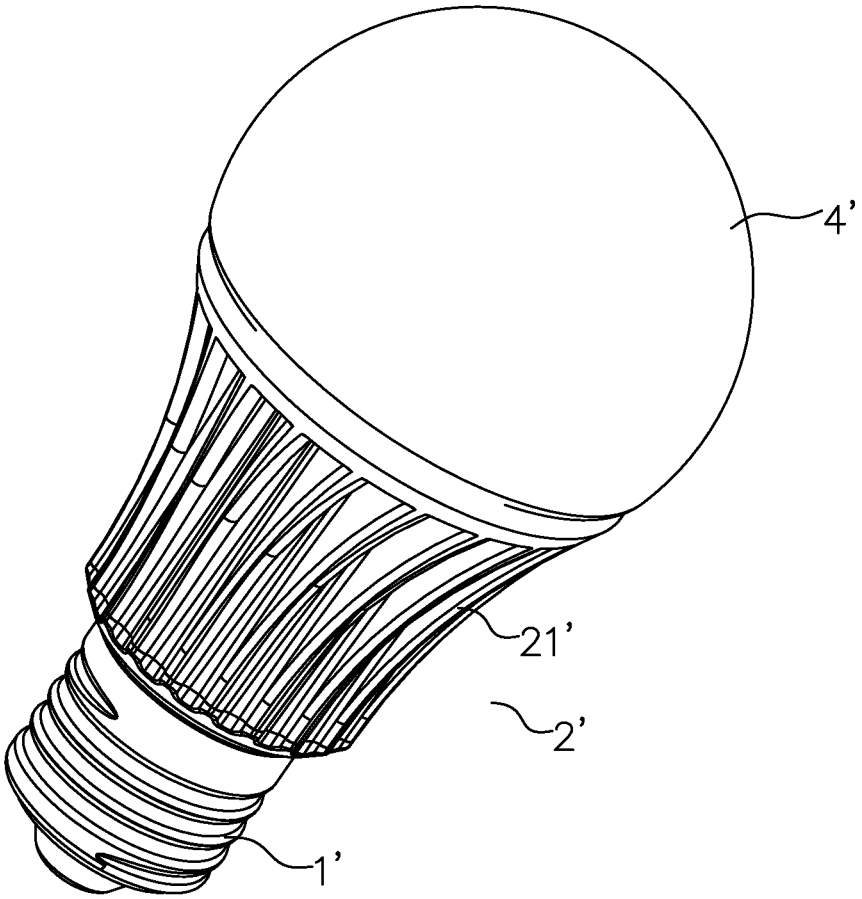
Prior Art F I G. 1
FIG. 1 is a schematic view illustrating an outside appearance of a conventional LED bulb lamp.
Figure 2:
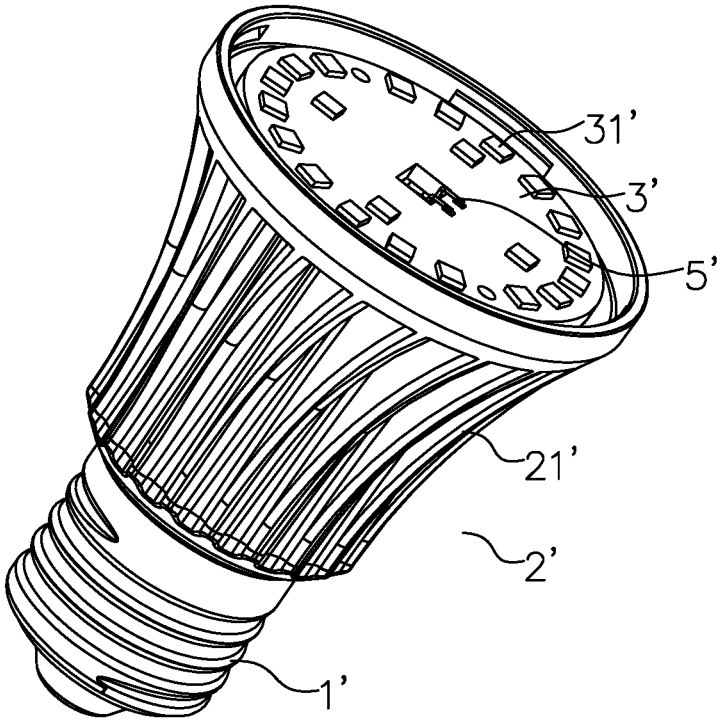
Prior Art F I G. 2
FIG. 2 is a schematic view showing the structure of a portion of the conventional LED bulb lamp.
Figure 3:
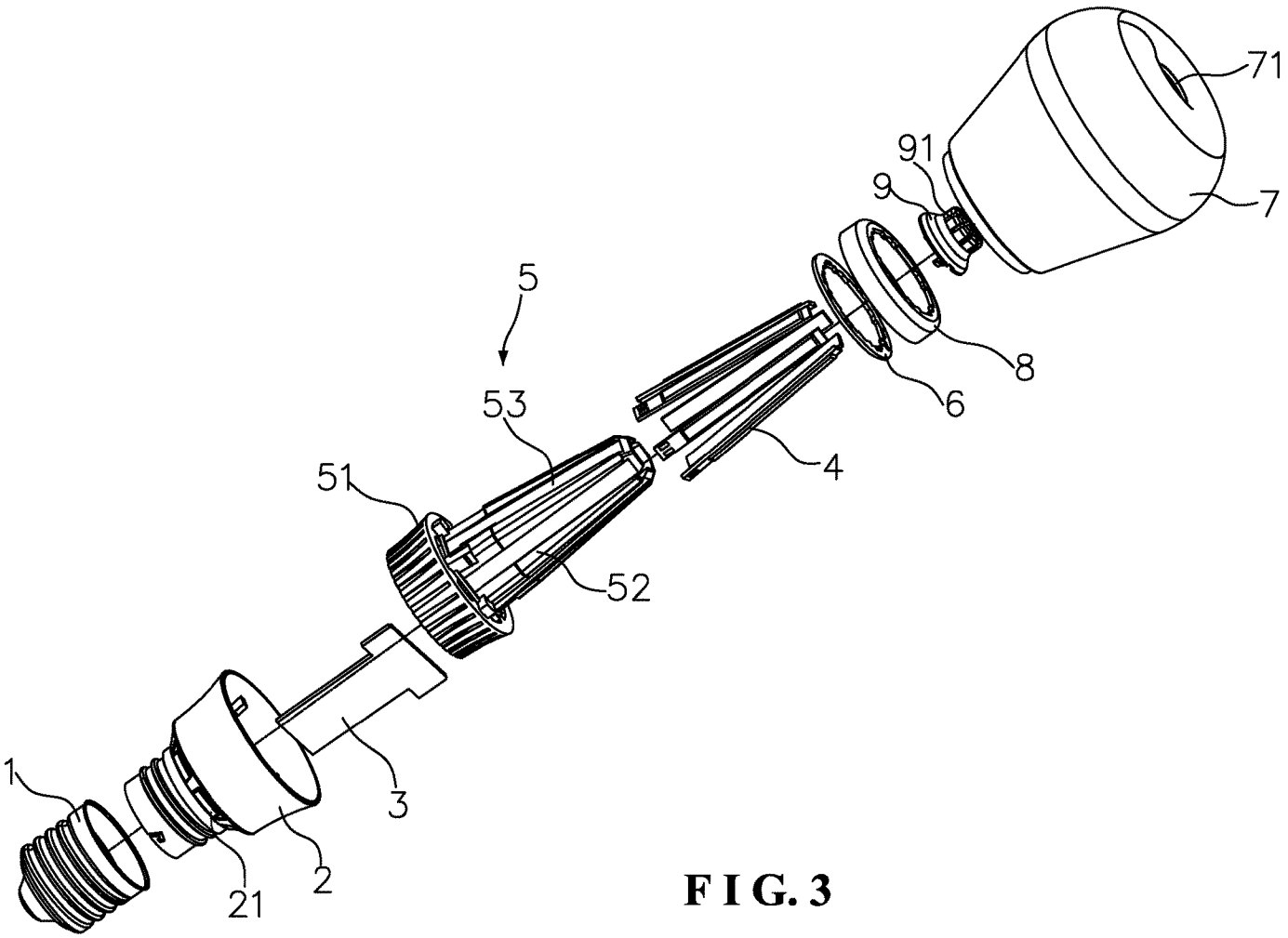
FIG. 3 is an exploded view of the present invention.
Figure 4:
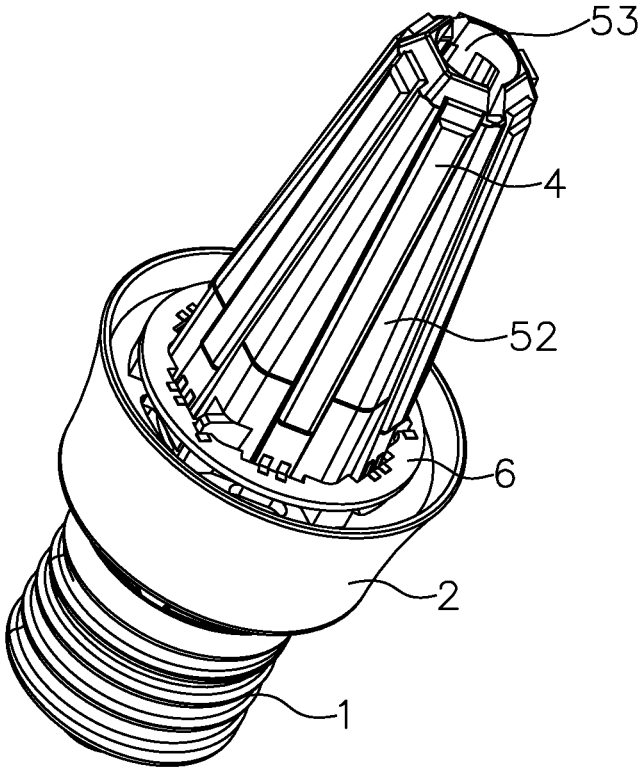
FIG. 4 is a schematic view illustrating a portion of the present invention in an assembled form.
Figure 5:
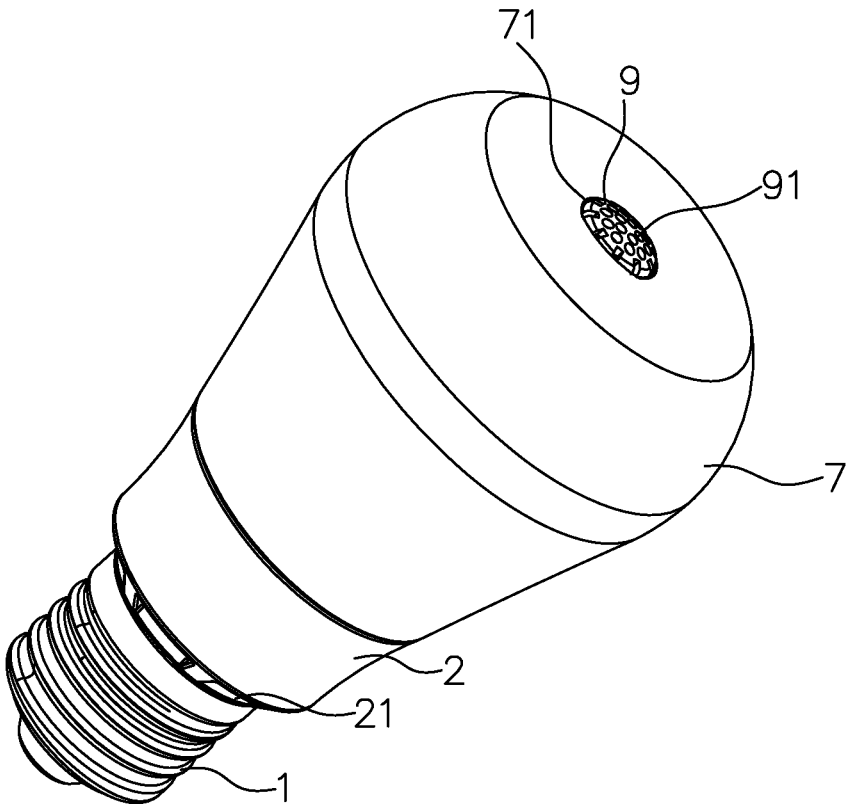
FIG. 5 is a schematic view illustrating the present invention in an assembled form.
Figure 6:
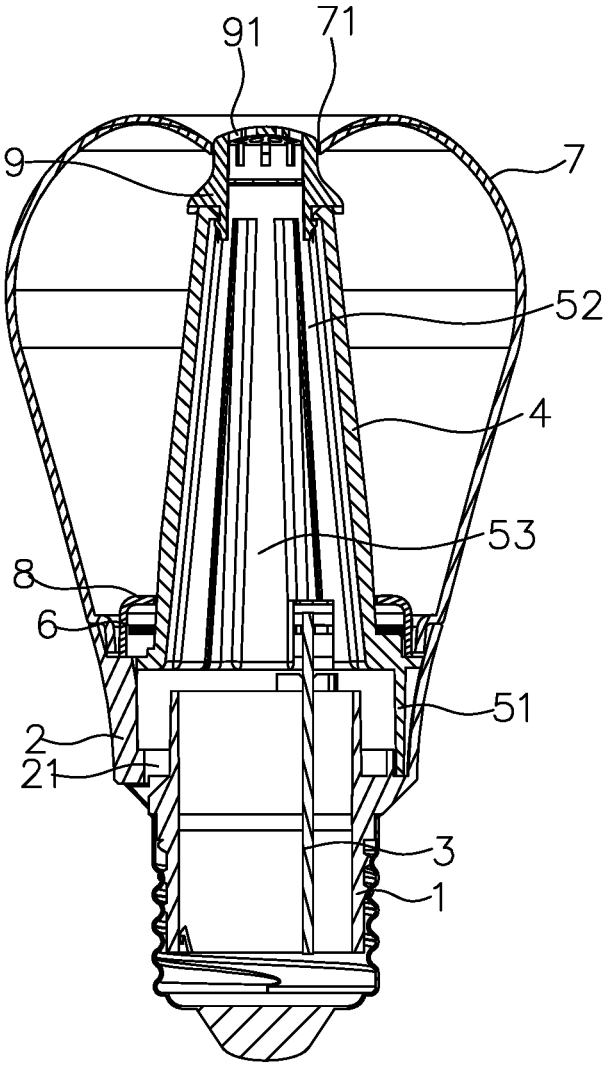
FIG. 6 is a cross-sectional view of the present invention in an assembled form.

As shown in FIGS. 3-6, the present invention discloses a bulb lamp structure, which comprises a base 1, a seat 2, a circuit board 3 for driving light-emitting diode (LED) chips, a plurality of chips 4 on which LEDs are mounted, a heat dissipater 5, a double-sided board 6 connecting between the chips 4 and the circuit board 3, and a bulb housing 7.

The base 1 is coupled to a lower end of the seat 2. The seat 2 is provided with one or more air inlet openings, and in the instant embodiment, air inlet openings 21 are formed in and distributed along a lower rim of the seat 2 that is adjacent to the base 1. The heat dissipater 5 has a lower portion forming an annular hood 51 that corresponds to and is received and mounted in the seat 2. Arranged on an upper end of the annular hood 51 is a plurality of plate-like substrates 52 that extends upward and is spaced from each other. The plate-like substrates 52 circumferentially surround and delimit a chamber 53. The chamber 53 is shaped to show a configuration that is gradually reduced from bottom to top so that a top end of the chamber 53 is convergent to form an air outlet opening. The bottom of the chamber 53 is in communication with the air inlet openings 21 of the seat 2. The circuit board 3 is arranged, in a longitudinal direction, in the seat 2 and has an upper end thereof positioned in abutting engagement with the heat dissipater 5 and a lower end connected to the base 1. The chips 4 are respectively set on and mounted to outside surfaces of the plate-like substrates 52. The double-sided board 6 is fit to and encompasses the heat dissipater 5 and is connected to the chips 4 and the circuit board 3. The bulb housing 7 encloses and houses the chips 4 and is coupled to the seat 2. The bulb housing 7 comprises a ventilation hole 71 formed in a central portion of a top end thereof and corresponding exactly to the air outlet opening that is located in an upper end of the heat dissipater 5.

A cover plate 8 is further provided above the double-sided board 6. The cover plate 8 is in the form of an annular cover that is fit over and encompasses the plate-like substrates 52 to be located above the double-sided board 6.

Each of the plate-like substrates 52 of the heat dissipater 5 has an upper end that is constrained in position by a cap 9. The cap 9 comprises air passage openings 91 formed therein and in communication with the chamber 53. The air passage openings 91 are arranged to extend to a site corresponding to the ventilation hole 71 of the bulb housing 7.

The LED bulb lamp so structured provides the following efficacy:

(1) The bulb lamp has excellent effect of heat dissipation. The heat dissipater 5 is composed of a plurality of plate-like substrates 52 on which the chips 4 are mounted such that spacing gaps among the plate-like substrates 52 may serve as airflow passages. In addition, the plate-like substrates 52 are arranged in the longitudinal direction to circumferentially surround and delimit the chamber 53 of which the bottom is in communication with the air inlet openings 21 of the seat 2 and the top is in communication with the ventilation hole 71 of the bulb housing 7. The chamber is shaped to show an expanded top and a reduced bottom so as to define an airflow channel therein, whereby when the LEDs are put into operation, high temperature air inside the bulb housing 7 moves through the airflow passages and then the airflow channel to move out of the bulb housing. In other words, heat dissipation of the LEDs according to the present invention is achieved through airflows. This, when compared with the conventional LED bulb lamp where heat dissipation is conducted through physical contact with heat dissipation fins of a seat, provides a more efficient way of heat dissipation and thus exhibits better heat dissipation performance, making it advantageous to the lifespan of the LEDs.

(2) The outside configuration is closer to that of a traditional incandescent bulb. The plate-like substrates 52 of the heat dissipater 5 are arranged in the longitudinal direction and are distributed in circumferential direction so that the chips 4 are arranged in a three-dimensional form inside the bulb housing 7. A bulb lamp constructed in this way does not show an enlarged seat in the outside configuration thereof so that the outside configuration is much closer to a traditional incandescent bulb.

(3) A large illumination angle can be achieved and a wide range may be covered. The chips 4 are arranged in a three-dimensional form in the bulb housing 7. This, compared to a planar arrangement of chips of a conventional LED bulb lamp, provides an enlarged illumination angle for the entire LED bulb lamp and a widened range of illumination may be achieved.

(4) Throughput is high. In the bulb lamp of the present invention, the chips 4 are connected to the circuit board 3 via the double-sided board 6. This facilitates realization of automatic production so that throughput can be effectively increased and the manufacture cost can be lowered down.

In summary, the present invention provides an LED bulb lamp that can effectively and better handles heat dissipation issues of chips of an LED bulb lamp and also achieves a large illumination angle of an LED bulb lamp and provides an efficacy of facilitating automatic production.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A bulb lamp structure, comprising a base, a seat that is coupled to the base, a circuit board that drives light-emitting diode (LED) chips, and a bulb housing that encloses and houses the chips and is coupled to the seat, characterized by comprising a plurality of chips on which LEDs are mounted, a heat dissipater, and a double-sided board that electrically connects the chips to the circuit board; the seat has a lower portion in which an air inlet opening is formed and the heat dissipater has a lower portion that forms an annular hood received and mounted in the seat, the annular hood having an upper end to which a plurality of plate-like substrates is mounted to extend upward in a manner of being spaced from each other, the plate-like substrates being circumferentially arranged to surround and delimit a chamber, the chamber being in a form of gradually reducing from bottom to top so that a top end of the chamber is convergent to form an air outlet opening, the chamber having a bottom that is in communication with the air inlet opening of the seat, the circuit board being arranged, in a longitudinal direction with respect to the bulb lamp structure, in the seat, the chips being respectively mounted to outside surfaces of the plate-like substrates, the bulb housing having a top end having a central portion in which a ventilation hole is formed to correspond to the air outlet opening located in an upper end of the heat dissipater.

2. The bulb lamp structure according to claim 1, characterized in that the seat has a lower rim that is adjacent to the base and comprises the air inlet opening arranged therein.

3. The bulb lamp structure according to claim 2, characterized in that a cover plate is further provided above the double-sided board, the cover plate being in the form of an annular cover that is fit over and encompasses the plate-like substrate to be located above the double-sided board.

4. The bulb lamp structure according to claim 2, characterized in that each of the plate-like substrates of the heat dissipater has an upper end that is constrained in position by a cap, the cap comprising an air passage opening formed therein and in communication with the chamber, the air passage opening being arranged to extend to a site corresponding to the ventilation hole of the bulb housing.

5. The bulb lamp structure according to claim 1, characterized in that the circuit board has an upper end positioned in abutting engagement with the heat dissipater and a lower end connected to the base, the double-sided board being fit over and encompassing the heat dissipater and connected to the chips and the circuit board.

6. The bulb lamp structure according to claim 5, characterized in that a cover plate is further provided above the double-sided board, the cover plate being in the form of an annular cover that is fit over and encompasses the plate-like substrate to be located above the double-sided board.

7. The bulb lamp structure according to claim 5, characterized in that each of the plate-like substrates of the heat dissipater has an upper end that is constrained in position by a cap, the cap comprising an air passage opening formed therein and in communication with the chamber, the air passage opening being arranged to extend to a site corresponding to the ventilation hole of the bulb housing.

8. The bulb lamp structure according to claim 1, characterized in that a cover plate is further provided above the double-sided board, the cover plate being in the form of an annular cover that is fit over and encompasses the plate-like substrate to be located above the double-sided board.

9. The bulb lamp structure according to claim 1, characterized in that each of the plate-like substrates of the heat dissipater has an upper end that is constrained in position by a cap, the cap comprising an air passage opening formed therein and in communication with the chamber, the air passage opening being arranged to extend to a site corresponding to the ventilation hole of the bulb housing.

* * * * *